US005388358A

United States Patent [19]

Mazhar

[11] Patent Number: 5,388,358

[45] Date of Patent: Feb. 14, 1995

[54] IDENTIFICATION BOARD

[75] Inventor: Mohammad S. Mazhar, Sterling Heights, Mich.

[73] Assignee: The United States of America as represented by the Secretary of the Army, Washington, D.C.

[21] Appl. No.: 245,793

[22] Filed: May 19, 1994

[51] Int. Cl.[6] ..... G09F 13/16; G09F 7/08

[52] U.S. Cl. ..... 40/582; 40/611; 52/814; 116/209; 116/28 R

[58] Field of Search ..... 52/814, 105; 40/582, 40/611, 618, 649; 116/209, 202, 28 R, 42, 44; 296/21

[56] References Cited

U.S. PATENT DOCUMENTS

| | | | |
|---|---|---|---|
| 1,405,915 | 2/1922 | Haskel | 40/611 |
| 1,858,975 | 5/1932 | Ta'Bois | 40/582 |
| 2,869,424 | 1/1959 | Hammer | 116/44 X |
| 3,055,467 | 9/1962 | Peek et al. | 52/814 X |
| 4,040,760 | 8/1977 | Wyckoff | 40/582 X |
| 4,106,229 | 8/1978 | Schmid | 40/611 |
| 4,553,345 | 11/1985 | Bercier et al. | 40/618 X |
| 5,023,451 | 6/1991 | Burley | 40/582 X |

*Primary Examiner*—Carl D. Friedman
*Assistant Examiner*—Laura A. Saladino
*Attorney, Agent, or Firm*—Peter A. Taucher; David L. Kuhn

[57] ABSTRACT

An identification board for a combat vehicle mounts to a panel of the vehicle within a generally planar space envelope at the panel. The board comprises a pair of upright channels having an open upper end and a closed lower end, faciae oriented at an oblique angle to a horizontal reference plane and gradins oblique to the faciae and alternated with the faciae. The faciae and the gradins together defining sheet edge zones closely and slidingly fit with the channels. First faces of the faciae have a layer reflecting one or more light frequencies, and second, oppositely oriented faces of the faciae have means to render the second face less reflective of the light frequencies than the layer.

10 Claims, 5 Drawing Sheets

IDENTIFICATION BOARD

GOVERNMENT USE

The invention described here may be made, used and licensed by or for the U.S. Government for governmental purposes without paying me a royalty.

BACKGROUND AND SUMMARY

Historically, one of the most perplexing problems of warfare is to avoid harming one's own forces or those of an ally during battle. For example, in Operation Desert Storm, most of the casualties to the U.S. and its allies was from friendly forces unable to distinguish between friendly and enemy vehicles. One solution to this problem is the use of unique infrared signature elements on friendly vehicles in a combat zone. It is essential that these elements be detectable by friendly aircraft as well as friendly ground combat units.

It has been suggested that optically coated flaps or plates be attached to vehicles and held at about a 70° angle relative to level ground. These allow the vehicle to have an identifiable infrared signature element. However, the flaps or plates extend so far outboard from the vehicle that they interfere with the vehicle's mobility in constricted areas. I propose a spatially efficient identification board for combat vehicles which gives them unique signature elements without hampering vehicle mobility. The board is easily reversible so that the vehicle can lose or regain its unique signature elements as desired.

DETAILED DESCRIPTION

Figure 2:
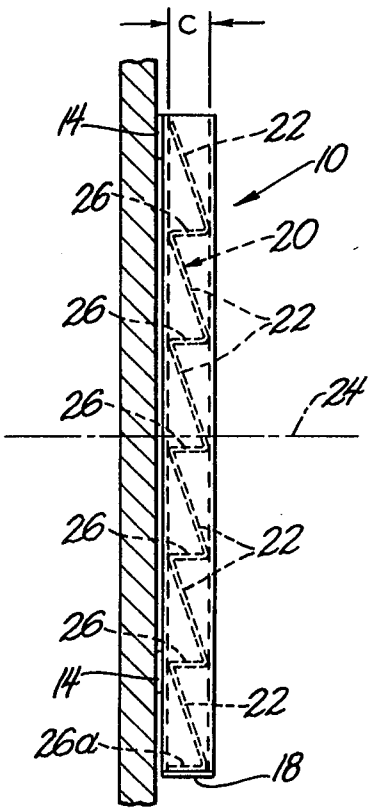
FIG. 2 is a sectional view taken along line 2—2 in FIG. 1.
Figure 1:
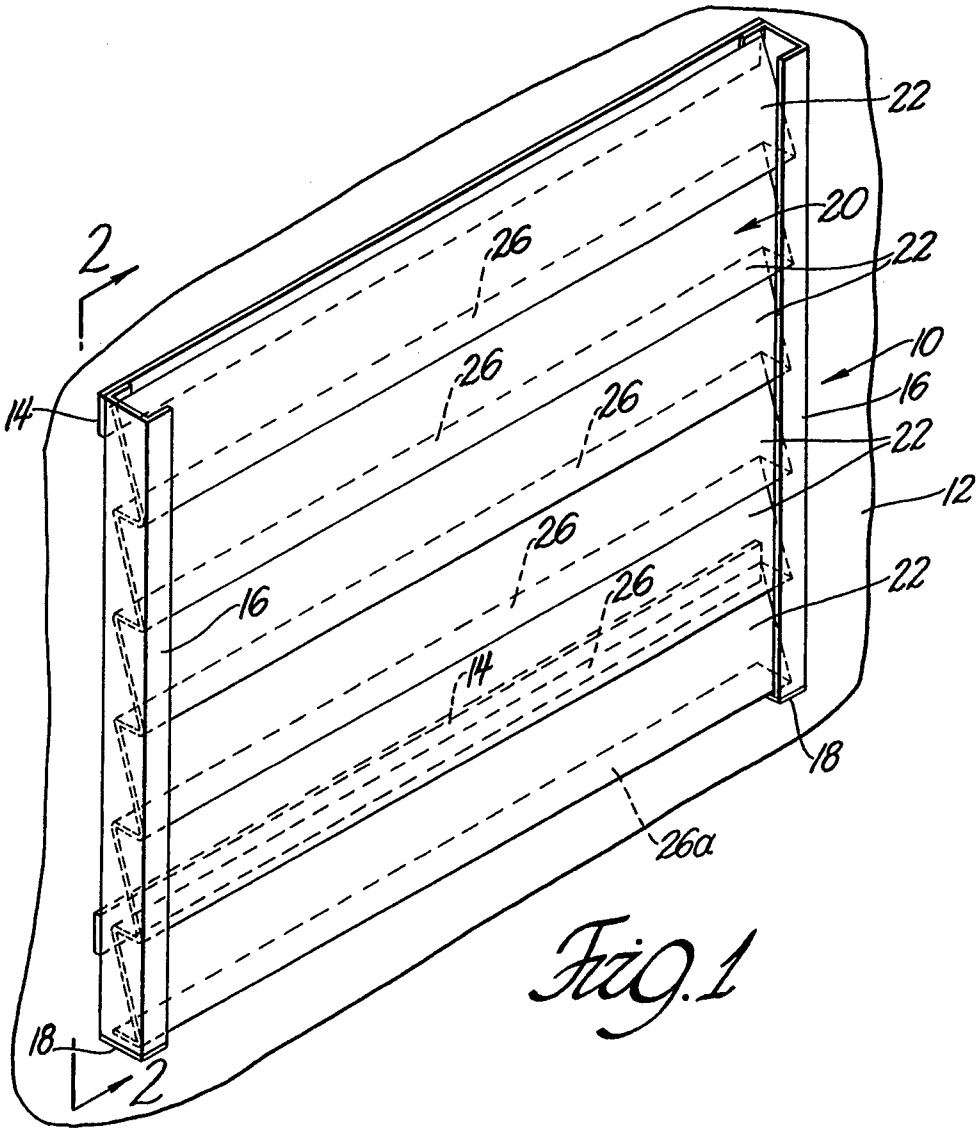
FIG. 1 is a left front perspective view of the first embodiment of the identification board.
Figure 3:
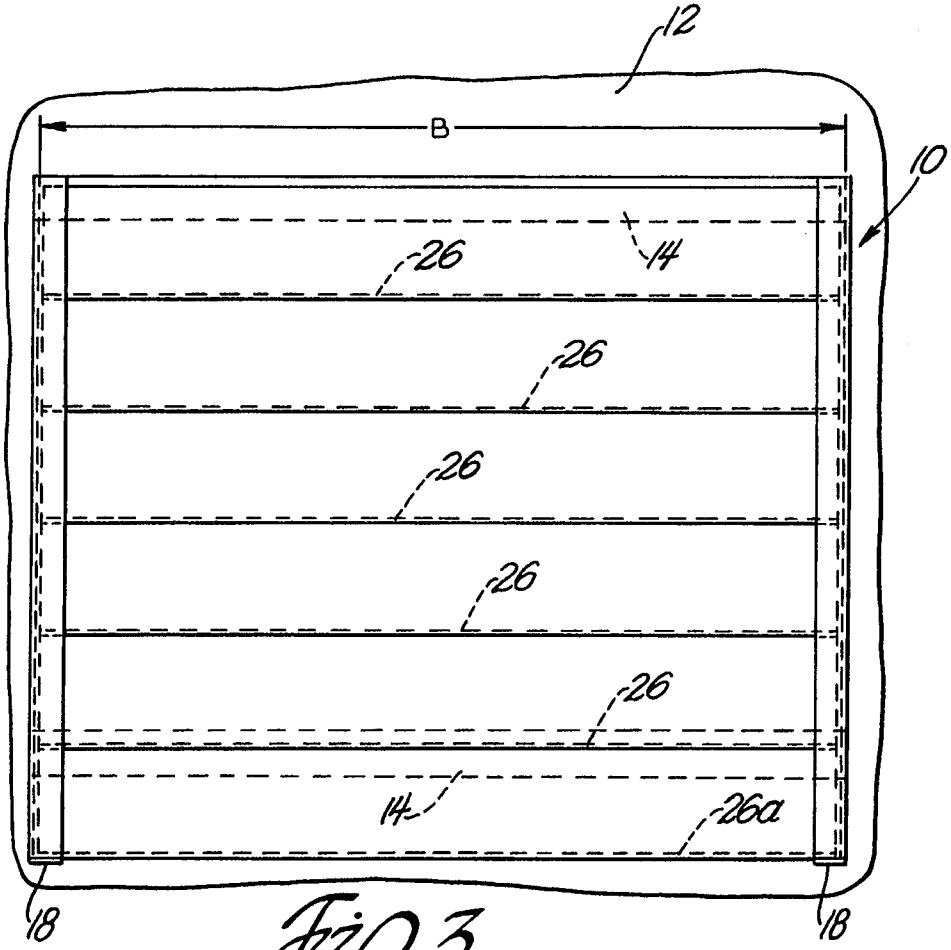
FIG. 3 is a front elevational view of the first embodiment of the identification board.

FIGS. 1, 2 and 3 show identification board 10 affixed to an exterior vertical panel 12 of a military vehicle (not shown). Fixed by any suitable means to panel 12 are two parallel flat mounting bars 14 to which can be removably attached, by bolts or like fasteners, brackets that form elongate parallel vertical channels 16. In the alternative the brackets can be mounted directly to panel 12. These brackets or channels are open toward one another and terminate at wall-like stops 18 affixed to the channels at their lower ends. Bars 14 and channels 16 can serve as an exterior frame for panel 12 if desired.

Figure 4:
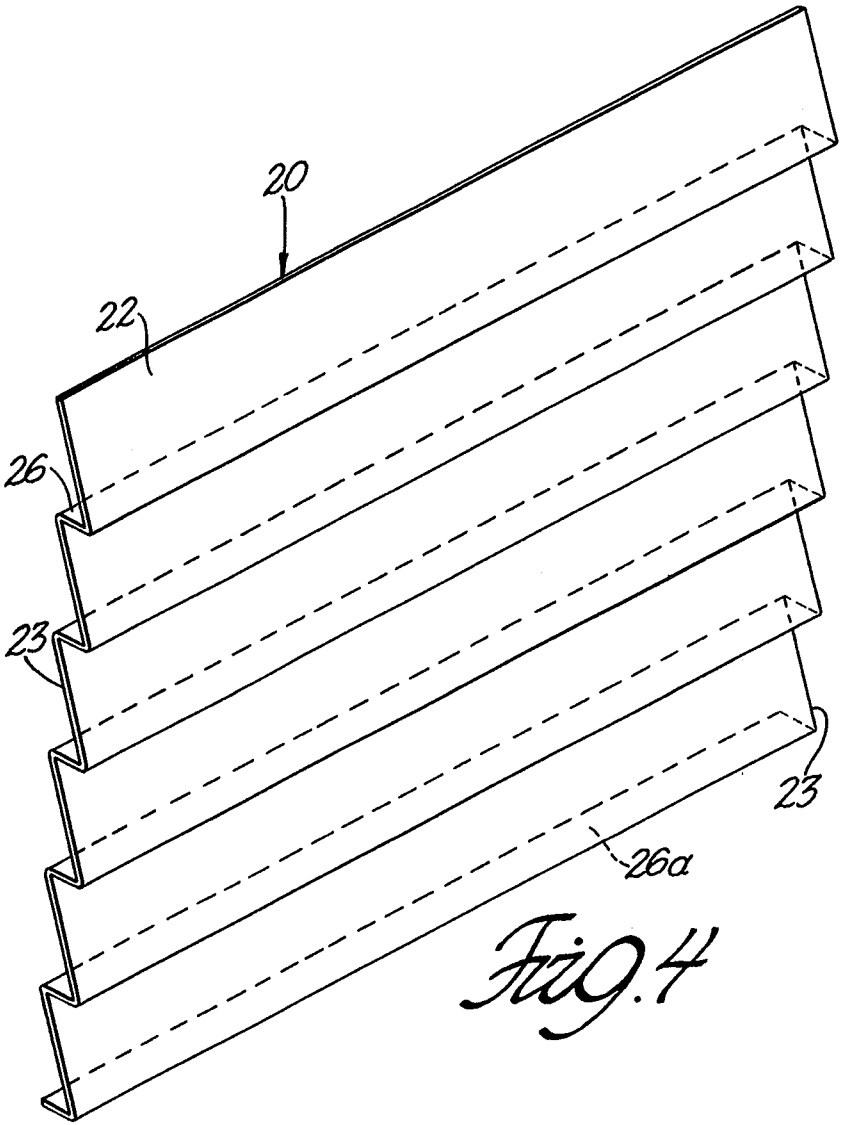
FIG. 4 is a left front perspective view of a sharply cornered corrugated sheet forming part of the identification board of FIG. 1.

As perhaps most clearly seen in FIG. 4, a corrugated sheet 20 has zig-zag edges 23 that fit closely and slidably, but preferably not interferingly, in channels 16. The fit between edges 23 and channels is slidably close in both the inter-channel width dimension "B" (FIG. 3) and in the intra-channel depth dimension "C" (FIG. 2) between opposed intra-channel walls. Consequently, fasteners will not be needed to keep corrugated sheet 20 from escaping channels 16.

Figure 9:
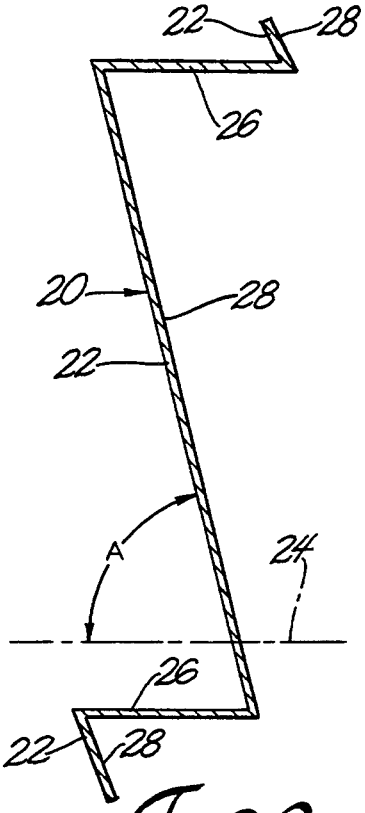
FIG. 9 is a detail sectional view of the corrugated sheet shown in FIGS. 1 through 4.

Corrugated sheet 20 is comprised of flat elongate fasciae 22 oriented at angle "A" of typically 70° to horizontal reference line or plane 24 as seen in FIG. 9. Alternated with and integrally formed with fasciae 22 are flat elongate gradins 26 parallel to horizontal reference line 24. The gradins extend away from panel 12 along their inboard-to-outboard, or width dimension, and the respective ends of gradins and fasciae together define the aforementioned sheet edge 23. The ends of lowest gradin 26*a* rests on stops 18 and a majority of the downward facing surface of gradin 26*a* is exposed so that one can push up against this surface to remove sheet 20 from channels 16. The assembly comprised of channels 16, faciae 20 and gradins 26 lies in a flat, generally planar zone envelope adjacently parallel to panel 12 so as to minimize the size increase to the vehicle's space envelope caused by mounting the assembly to a vehicle.

In FIG. 9, a thick line depicts a layer comprised of a known tape or coating 28 on sheet 20. This layer causes the sheet to have a characteristic optical effect on the infrared image of panel 12, so that the vehicle with panel 12 is marked as a "friendly" and not an enemy. It is known to orient a flat, specially coated surface at a particular angle, as at "A", to horizontal reference plane 24 to maximize the characteristic optical effect. Coating or tape 28 is on only one side of corrugated sheet 20 and needs only be on faciae 22, but coating 28 may be on gradins 26 as well. The side of corrugated sheet opposite the coated side has low reflectivity. This opposing side also has little or no capacity to absorb light and then emit it at a different frequency. Corrugated sheet 20 can easily be removed from and replaced in brackets 16 so as to face coating 28 either toward or away from panel 12.

Figure 5:
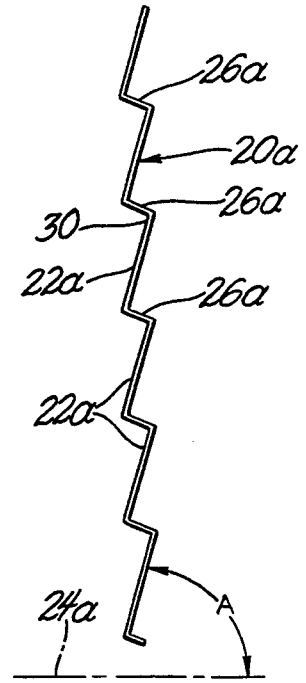
FIGS. 5, 6 and 7 are sectional view of alternate corrugated sheets usable with the identification board.
Figure 6:
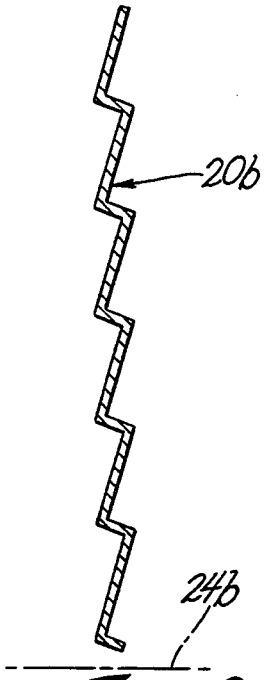
Figure 7:
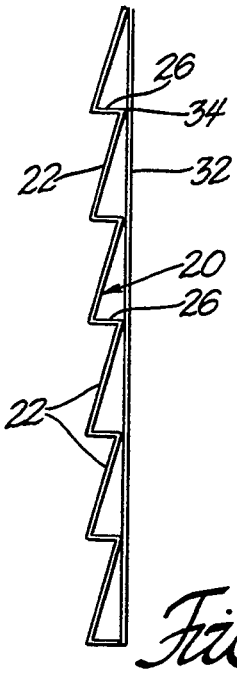

FIGS. 5, 6 and 7 show optional modifications to corrugated sheet 20. FIG. 5 shows corrugated sheet 20 having faciae 22*a* oriented at angle "A" to horizontal reference line 24*a* and gradins 26*a* oriented normal to fasciae 22*a*. Light reflected slightly upward off zone 30 of a fascia 22*a* will have lessened obstruction by a gradin 26*a* immediately above zone 30, whereby the reflectivity of sheet 20*a* is somewhat enhanced. FIG. 6 shows corrugated sheet 20*b* that is thicker and stronger than corrugated sheet 20*a* so that sheet 20*b* can act as a stiffening member for the vehicle panel where it is located. FIG. 7 shows corrugated sheet 20 having a nonreflective flat sheet 32 welded thereto at seams or corners 34 where fascia 22, gradin 26 and flat sheet 32 join, thereby forming a relatively stiff but light structure that can be slid into brackets 16.

Figure 8A:
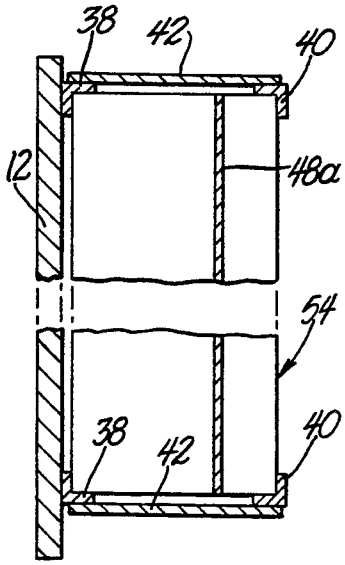
FIG. 8A is a view taken along line 8A—8A in FIG. 8.
Figure 8:
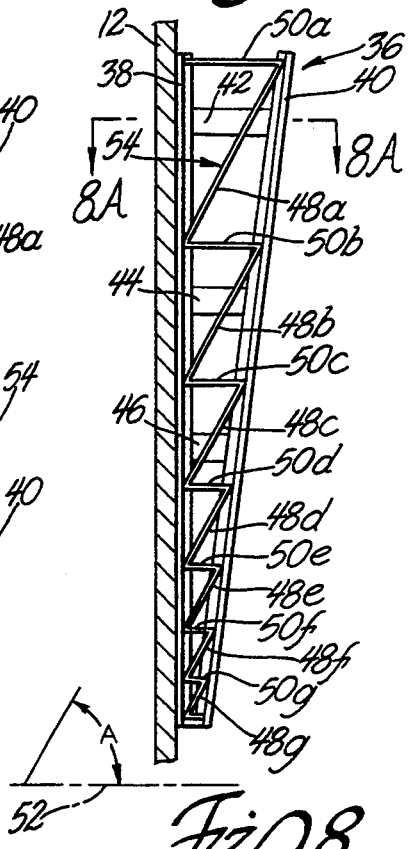
FIG. 8 shows a side sectional view of a second embodiment of the identification board.

FIGS. 8 and 8A show an alternate embodiment 36 for the identification board wherein brackets or channels 16 are replaced by a subassembly comprised of elongate right angle brackets 38, other right angle brackets 40, and cross members 42, 44, and 46. Brackets 38 are vertical and are bolted or welded directly to vehicle panel 12 whereas brackets 40 are not perfectly vertical and are disposed at an acute angle of, say, 3° to 10° relative to bracket 38. Brackets 40 are fixed to the opposing, associated one of brackets 38 by the cross members so as to form a pair of channels or an open frame that tapers downward. Fitting closely within the open frame is a modified corrugated sheet 54 having a series of decreasingly sized faciae 48*a* through 48*g* bordered by a series of decreasingly sized gradins 50*a* through 50*g*. Faciae 48*a* through 48*g* will be oriented at angle "A" relative to horizontal reference line 52 and gradins 50*a* through 50*g* will be parallel to horizontal line 52. The surfaces of the faciae in FIG. 8 that are oriented slightly upward and toward panel 12 have coating 28 (FIG. 9) on them and the reverse side of these faciae will have the non-reflective, non-emitting character previously discussed with reference to FIG. 9. Corrugated sheet 54 can be removed and replaced in the open frame so that the coated sides of the faciae face away from panel 12.

Figure 10:
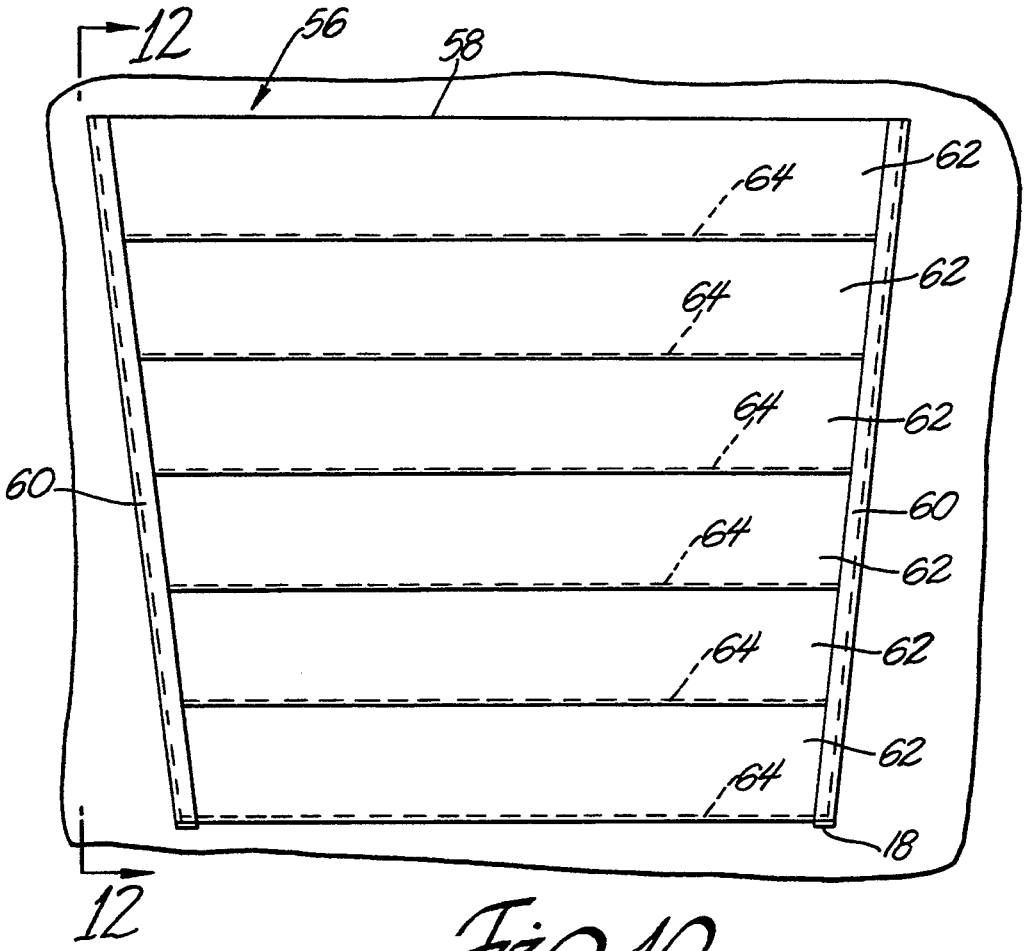
FIG. 10 shows a front elevational view of a third embodiment of my identification board.
Figure 12:
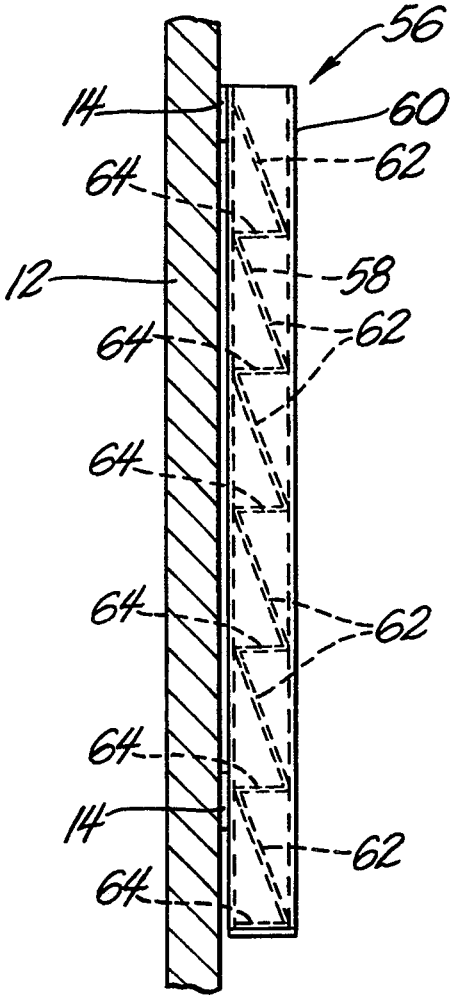
FIG. 12 is a line taken along line 12—12 in FIG. 10.

In FIGS. 10 and 12 is shown an alternate embodiment 56 of the identification board whose brackets or channels 60 diverge in an upward direction but are otherwise similar to channels 16. Corrugated sheet 58 is similar to sheet 20 except that corrugated sheet 58 has diverging lateral edges such that faciae 62 and gradins 64 progressively shorten in the downward direction, so that sheet 58 has an overall trapezoidal shape that fits closely in channels 60. The configuration of board 60 prevents sheet 58 from being placed up side down in channels 60.

Figure 11:
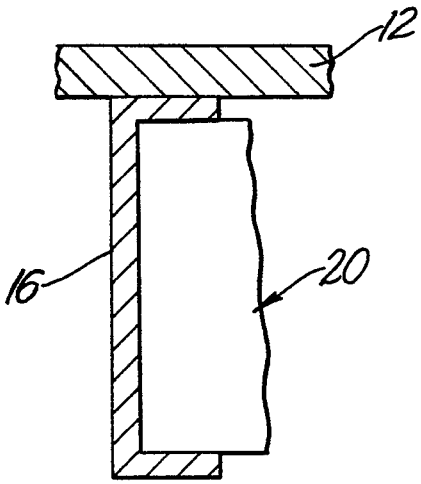
FIGS. 11 and 11A are cross sectional views of brackets that may be used to hold the corrugated sheet against a vehicle panel.
Figure 11A:
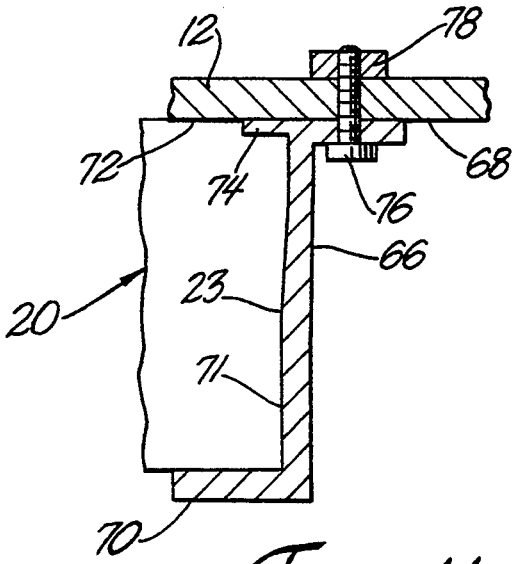

FIG. 11 is a detail sectional view of bracket 16 and surrounding structure and FIG. 11A shows a Z bracket 66 that varies in the cross sectional from the shape of bracket 16. Bracket 66 has an inboard leg 68 bearing against wall 12 and an outboard leg 70 closely fit with corrugated sheet 20, which itself is closely fit to wall 12 at interface 72. Connecting leg 68 and leg 70 is a web 71, which cooperates with a neighboring zone of panel 12 and leg 70 to define a channel at the edge of sheet 20. Spur 74 projects from web 71 between wall 12 and sheet 20 so that a portion of sheet 20 is trapped between spur 74 and leg 70. Bracket 66 will be one of a complementary pair of Z brackets, and the other Z bracket of the pair will be the mirror image of bracket 66. A bolt, screw or similar fastener 76 threads through inboard leg 68, through wall 12 and into nut 78, which may or may not be welded to wall 12.

The Z brackets will be disposed along either edge 23 of corrugated sheet 20 such that the respective outboard legs project toward each other and the respective spurs project toward each other. Consequently sheet 20 can only move up or down relative to wall 12, can not move horizontally along wall 12, and can not move inboard or outboard of wall 12. The juxtaposition of the Z brackets with corrugated sheet 20 and the location of fasteners 76 on the outboard legs 70 allows easy removal of the sheet and brackets as a unit from wall 12.

I do not desire to be limited to the exact details of construction or method shown herein since obvious modifications will occur to those skilled in the relevant arts without departing from the spirit and scope of the following claims.

I claim:

1. An identification board mountable on a panel, comprising:

a generally planar space envelope at the panel, the identification board located in the envelope;

a pair of upright brackets on the panel;

channels defined at least in part by the brackets, the channels having an open upper end and a closed lower end;

faciae oriented at an oblique angle to a horizontal reference plane;

first faces of the faciae;

second, oppositely oriented faces of the faciae;

a layer on the first face reflective of at least one selected frequency of light;

means on the second face to render the second face less reflective of the one selected frequency than the layer;

gradins oblique to the faciae and alternated with the faciae;

edge zones of at least some of the the faciae and gradins closely fit with the channels.

2. The board of claim 1 wherein the brackets are cross-sectionally Z-shaped members comprising:

a web;

an outboard leg extended from the from the web, spaced from the panel and disposed adjacently outboard the edge zones;

an inboard leg fixed to the panel and extended from the web in an opposite direction from the outboard leg;

wherein the outboard leg holds the edge zones against the panel.

3. The board of claim 2 further comprising a spur projected from the web adjacent the panel and parallel to the outboard leg, the spur contacting the edge zones.

4. The board of claim 1 wherein:

the brackets are parallel to the panel but are oblique to each other; and a corrugated sheet formed by the faciae and the gradins is a generally trapezoidal element tapering downward.

5. An identification board mountable on a panel, comprising:

a generally wedge shaped downward tapering space envelope at the panel, the identification board located in the envelope;

a pair of upright brackets fixed to the panel obliquely thereto;

channels defined in part by the brackets, the channels having an open upper end and a closed lower end;

faciae oriented at an oblique angle to a horizontal reference plane;

first faces of the faciae;

second, oppositely oriented faces of the faciae;

a layer on the first face reflective of at least one selected frequency of light;

means on the second face to render the second face less reflective of the one selected frequency than the layer;

gradins perpendicular to the faciae and alternated with the faciae;

the gradins and the faciae progressively decreasing in width in a downward sequence;

a generally wedge shaped subassembly element comprised of the faciae and the gradins, the element having edge zones closely fit with the channels.

6. A reversible identification board for a military vehicle mountable on an exterior panel of the vehicle, comprising:

a generally planar space envelope adjacently against the panel in which the identification board is located;

a pair of elongate vertical brackets affixed to the panel;

elongate vertical channels defined at least in part by the brackets, the channels having an open upper end and a closed lower end;

a multiplicity of elongate flat faciae whose lengths are parallel to a horizontal reference plane and whose widths are oriented at an oblique angle to the horizontal reference plane;

first, upward tilted faces of the faciae;

second, oppositely oriented faces of the faciae;

a layer on the first faces reflective of at least one selected frequency of light;

means for rendering the second face nonreflective of the selected frequency;

a multiplicity of elongate gradins oblique to the faciae and integrally alternated with the faciae, the gradins extending width wise away from the panel;

a corrugated sheet formed by the faciae and the gradins, the sheet removably engaged with the channels;

sheet edge zones comprised of ends of the faciae and ends of the gradins, the edge zones closely and slidably fit with the channels.

7. The board of claim 6 including a bottom portion of the sheet having an exposed, downward faced surface.

8. The board of claim 6 wherein the edge zones fit closely, slidably and horizontally both between the channels and between opposed intra-channel surfaces of each of the channels.

9. The board of claim 8 wherein the gradins are parallel to the horizontal reference plane.

10. The board of claim 6 wherein the rendering means is also a means for stiffening the board and comprises a flat sheet fixed to the fasciae and the gradins at seams between the fasciae and the gradins.

* * * * *